US007018323B1

(12) United States Patent
Reynolds et al.

(10) Patent No.: US 7,018,323 B1
(45) Date of Patent: Mar. 28, 2006

(54) ROPE CLIMBING APPARATUS

(76) Inventors: Lynn Reynolds, 715 W. Parks Hwy., Wasilla, AK (US) 99654; Fred Maestas, 715 W. Parks Hwy., Wasilla, AK (US) 99654

( * ) Notice: Subject to any disclaimer, the term of this patent is extended or adjusted under 35 U.S.C. 154(b) by 428 days.

(21) Appl. No.: 10/423,084

(22) Filed: Apr. 24, 2003

(51) Int. Cl.
*A63B 7/04* (2006.01)

(52) U.S. Cl. ..... 482/37; 482/112; 482/120

(58) Field of Classification Search ..... 482/23, 482/37, 49, 111–114, 118–120, 906, 51; 182/241; D21/676
See application file for complete search history.

(56) References Cited

U.S. PATENT DOCUMENTS

| | | | | |
|---|---|---|---|---|
| 641,519 | A | 1/1900 | Kerns | |
| 3,599,974 | A | 8/1971 | Price | |
| 3,782,718 | A | 1/1974 | Saylor | |
| 4,270,750 | A | 6/1981 | Malcolm | |
| 5,060,938 | A | 10/1991 | Hawley, Jr. | |
| 5,076,574 | A | 12/1991 | Johnson, Jr. | |
| D340,485 | S | 10/1993 | Fripps | |
| D343,876 | S | 2/1994 | McConnell | |
| 5,380,258 | A | 1/1995 | Hawley, Jr. | |
| 5,484,360 | A | 1/1996 | Haber et al. | |
| 5,496,234 | A | 3/1996 | Sussich | |
| 6,261,208 | B1 | 7/2001 | Carson, Jr. | |
| 6,808,474 | B1 * | 10/2004 | Tang | 482/51 |
| 2004/0014568 | A1 * | 1/2004 | Williams et al. | 482/37 |

FOREIGN PATENT DOCUMENTS

| | | | |
|---|---|---|---|
| DE | 20311330 | U1 * | 10/2003 |
| FR | 2420983 | | 10/1979 |
| FR | 2567028 | A1 | 1/1986 |
| FR | 2615400 | A1 * | 11/1988 |
| GB | 2341806 | A | 3/2000 |
| JP | 52023423 | A * | 2/1977 |
| WO | WO 2003076021 | A1 * | 9/2003 |

* cited by examiner

*Primary Examiner*—Stephen K. Cronin
*Assistant Examiner*—Victor K. Hwang
(74) *Attorney, Agent, or Firm*—Michael J. Tavella

(57) ABSTRACT

A portable, stable rope-climbing exercise machine. The machine has a stable support frame, a number of rope pulleys and rope guides mounted on the frame, an endless rope extending around the pulleys and guides to form a path which includes a vertically extending rope climbing portion, and hydraulic braking assembly coupled to the pulley system for controlling the rate of movement of the rope based upon the weight of the user when said user is climbing the rope. The machine allows a user to "climb" a rope continuously. The short frame allows the device to be installed anywhere. A seat with a footrest allows a user to gain leverage when exercising with the rope.

7 Claims, 7 Drawing Sheets

ROPE CLIMBING APPARATUS

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to rope climbing apparatus and particularly to rope climbing apparatus using endless ropes.

2. Description of the Prior Art

Climbing ropes have been a part of fitness gyms for many years. Rope climbing is an excellent exercise for the wrists, hands and upper body. Traditionally, these ropes have been long (20 foot) lengths of rope that were suspended from a gym ceiling. There are two problems with the traditional fixed rope as an exercise tool. First, there are few buildings used for gyms today that have high enough ceilings. Second, a 20-foot length of rope does not provide enough sustained effort to enable someone skilled in rope climbing exercise to receive a sufficient workout. Once a person has reached the top of the rope, he or she must descend before he or she can climb again.

To overcome these difficulties, endless rope exercise machines have been invented. These devices use a frame, an endless length of rope and a means of resistance to simulate actual rope climbing. Such machines enable a user to "climb" a rope for as long as the user's stamina permits. U.S. Pat. No. 5,076,574 discloses a portable rope climbing exercise apparatus that has a frame, a series of pulleys supporting a rope, and a hydraulic brake system to provide resistance for the rope. Although this system allows a climber to climb continuously, it has three main drawbacks. First, it requires the user to stand up to use the device. That means the device must be at least 8 feet tall or more. This again limits its use to only large rooms. Second, the frame of the device extends forward from the user. The rope travels up an inclined frame member. As a result, the bulk of the frame and mechanism require this device to be placed away from a wall. This again means that the device is limited to large rooms and is not suitable for modern compact gyms. Finally, the rope hangs vertically in front of the device and extends down to the frame (just above the floor). It loosely passes through the frame and back up to the top. Because of this, a tripping hazard is created where the rope meets the bottom of the frame. A user's foot can easily become entangled in the rope, or can create a twisting hazard with the rope. U.S. Pat. No. 5,496,234 also discloses an endless rope-climbing machine. This machine eliminates two of the drawbacks of the first device. First, the frame is compact and mounted to a wall, making it more suitable to small gyms. Second, the rope does not extend to the floor, thus eliminating the tripping hazard. It does have the limitation of being used while standing, which limits it again, to larger rooms. This device also has other problems. It has a pivoting feature that allows the unit to be rotated for certain exercises. Although this may seem to be more versatile, it requires the frame to be very heavy to support the pulling force and movements caused by changing the position of the frame. Second, the frictional braking system is relatively simple and does not provide dynamic resistance. It is a system of screw-adjustable friction pads. While useful, these pads do not provide the range of resistance a hydraulic braking system can provide.

BRIEF DESCRIPTION OF THE INVENTION

The instant invention overcomes all of these problems. It is a portable, stable rope climbing exercise machine that has a stable support frame that extends into the room, allowing the unit to be placed close to a wall; a plurality of rope pulleys and rope guides mounted to a friction drive mechanism. This leaves the frame free of rotating components; an endless rope extends around the pulleys and guides to form a path which includes a vertically extending rope climbing portion, and an hydraulic braking assembly coupled to the pulley system for controlling the rate of movement of the rope based upon the weight of the user when said user is climbing the rope. The key to this device is the seat portion, attached to the horizontal frame. This allows the user to sit (or more precisely assume a bent legged position) while using the machine. The rope passes through a hole in the seat, which eliminates any tripping hazard from the rope. Because the user sits to use the machine, the frame can be lower than 7 feet tall. This means the device can be placed in any ordinary room including compact gyms and even homes.

It is an object of this invention to provide an endless rope climbing machine that has a frame that permits the machine to be installed in any location.

It is another object of this invention to provide an endless rope climbing machine that provides a safe, protected pathway for the endless rope to travel.

It is a further object of this invention to provide an endless rope climbing machine that utilizes an efficient braking system to provide frictional tension on the rope, It is yet a further object of this invention to provide an endless rope climbing machine that provides alternate means of exercise using an endless climbing rope.

DETAILED DESCRIPTION OF THE INVENTION

Figure 1:
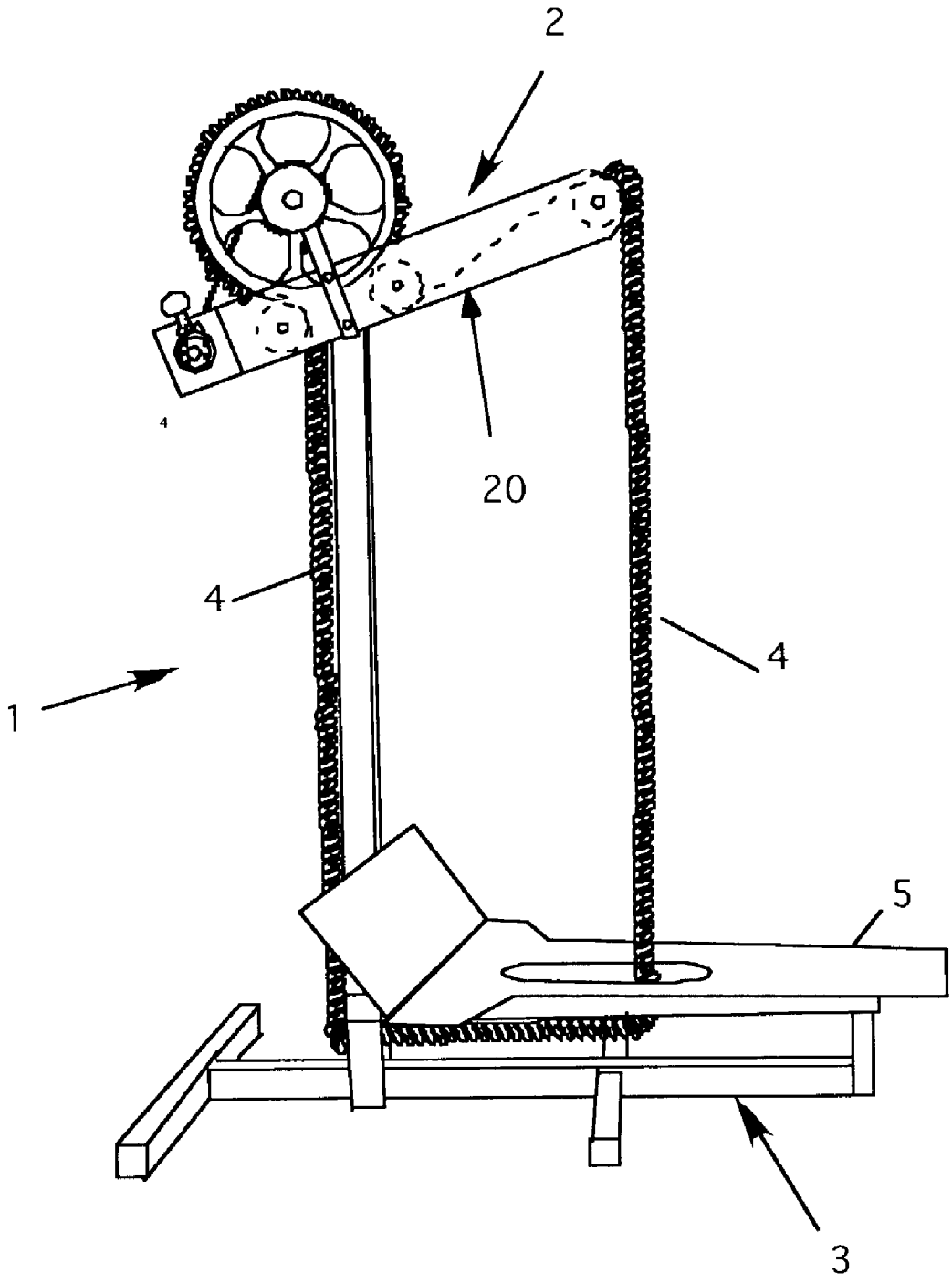
FIG. 1 is a left side view of the invention, showing the internal workings of the machine.
Figure 7:
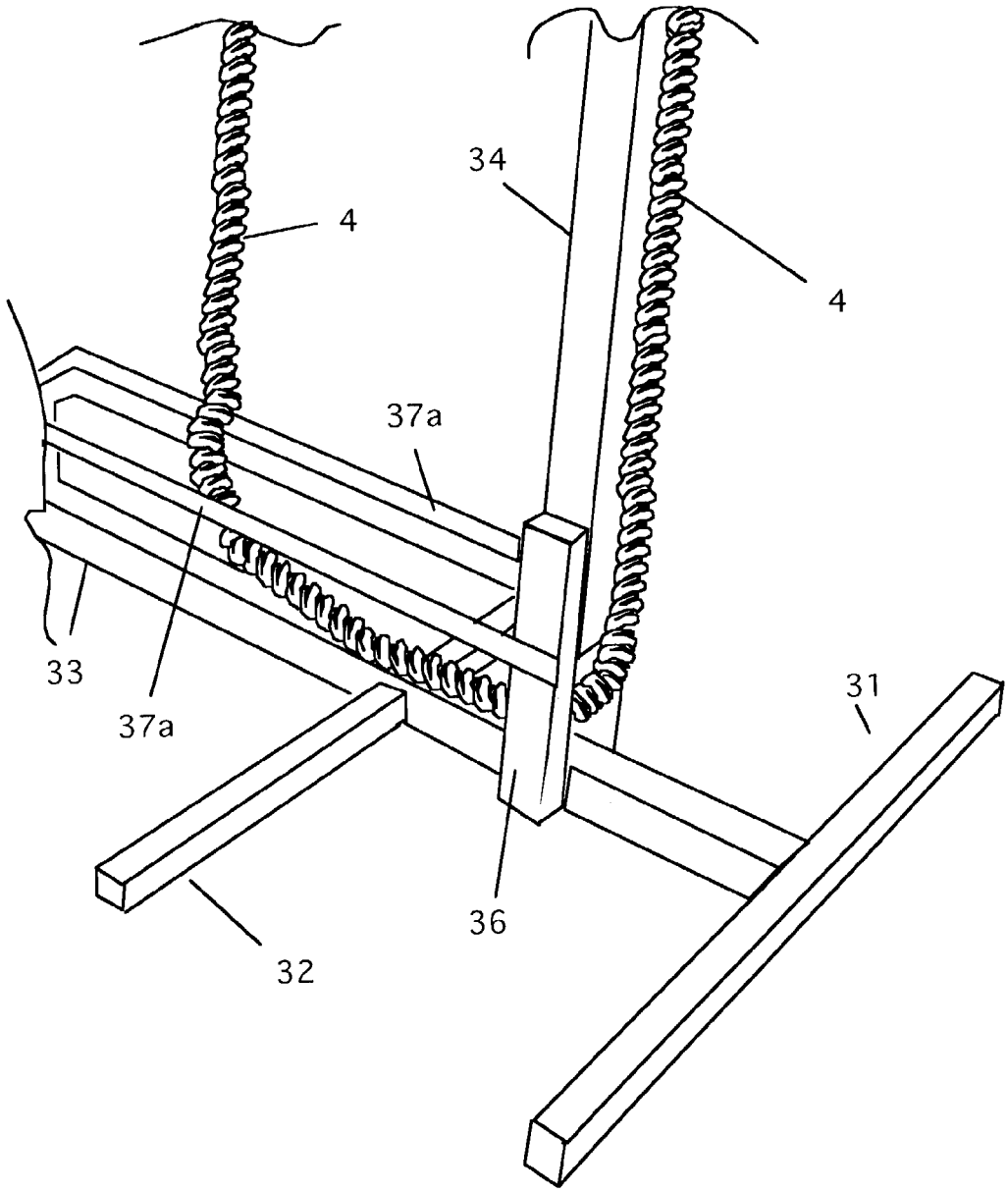
FIG. 7 is detail view of the lower frame showing the rope passing through the frame elements.

Referring now to FIG. 1, the invention 1, is shown with the internal workings of the machine exposed. In commercial use, the machine would be covered by a housing to protect the user and others from injury from contact with the mechanism. The housing is not shown here for clarity of the workings. The invention is a rope climbing device. It is a machine that uses a pulley and braking assembly 2 that is mounted on a frame 3 to support an endless rope 4 that is placed over the pulleys (see FIGS. 2 and 3). The rope hangs vertically from the pulley and braking assembly 2. A seat 5 is attached to the frame (as discussed below). The seat 5 has a hole 6 cut into it to allow the rope 4 to pass through as shown. The rope runs under the seat, through the frame, until it passes through the vertical support. See, e.g., FIG. 7. It then runs up to the pulley and braking assembly 2, completing the loop.

Figure 2:
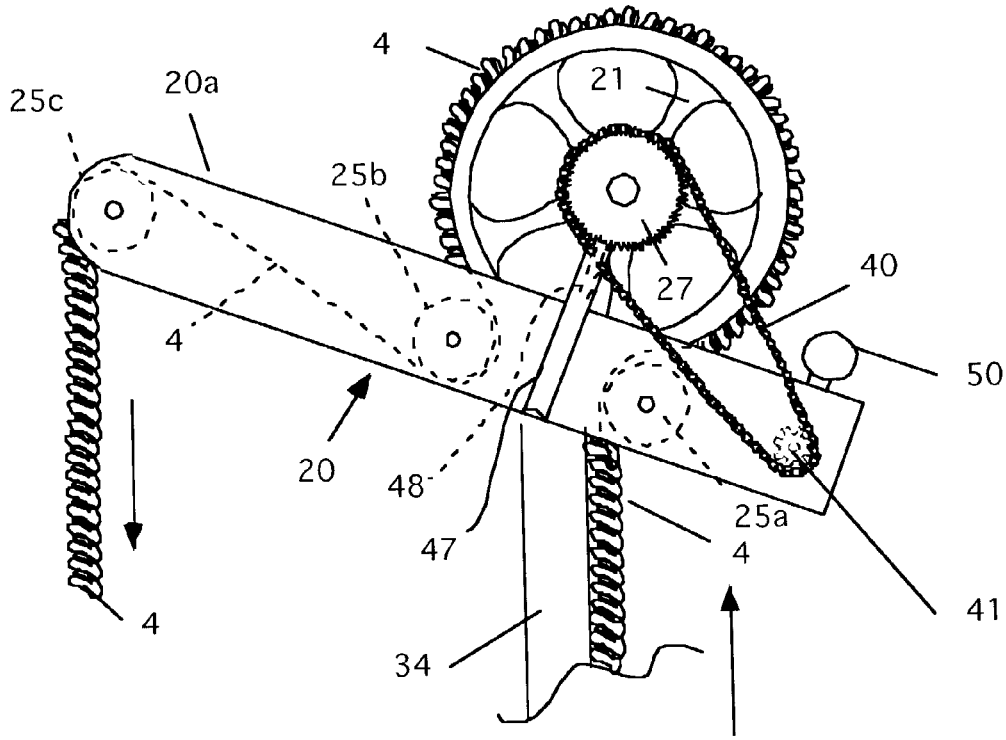
FIG. 2 is a detail view of the pulley and braking system from the right side of the machine.

FIG. 2 is a detail view of the pulley and braking system from the right side of the machine. This view shows a support arm 20 that attaches to the vertical support. The support arm consists of two parallel members 20*a* (see FIG. 2) and 20*b* (see FIG. 3). A main pulley 21 is attached to the arm 20 by a cylinder 47, which is held in place by fasteners (not shown). This piston is discussed in more detail below. The rope 4 comes up from below, where it passes over a first sheave 25*a*. The rope 4 then passes around the pulley 21. At the bottom of the pulley 21, the rope passes over the second sheave 25*b*. Finally, the rope 4 passes over the top of the third sheave 25*c*, where it descends down to the seat.

This figure also shows the main sprocket 27 that connects to a small drive sprocket 41 by a chain 40. The small sprocket 41 is attached to the shaft of the hydraulic pump 26.

Figure 3:
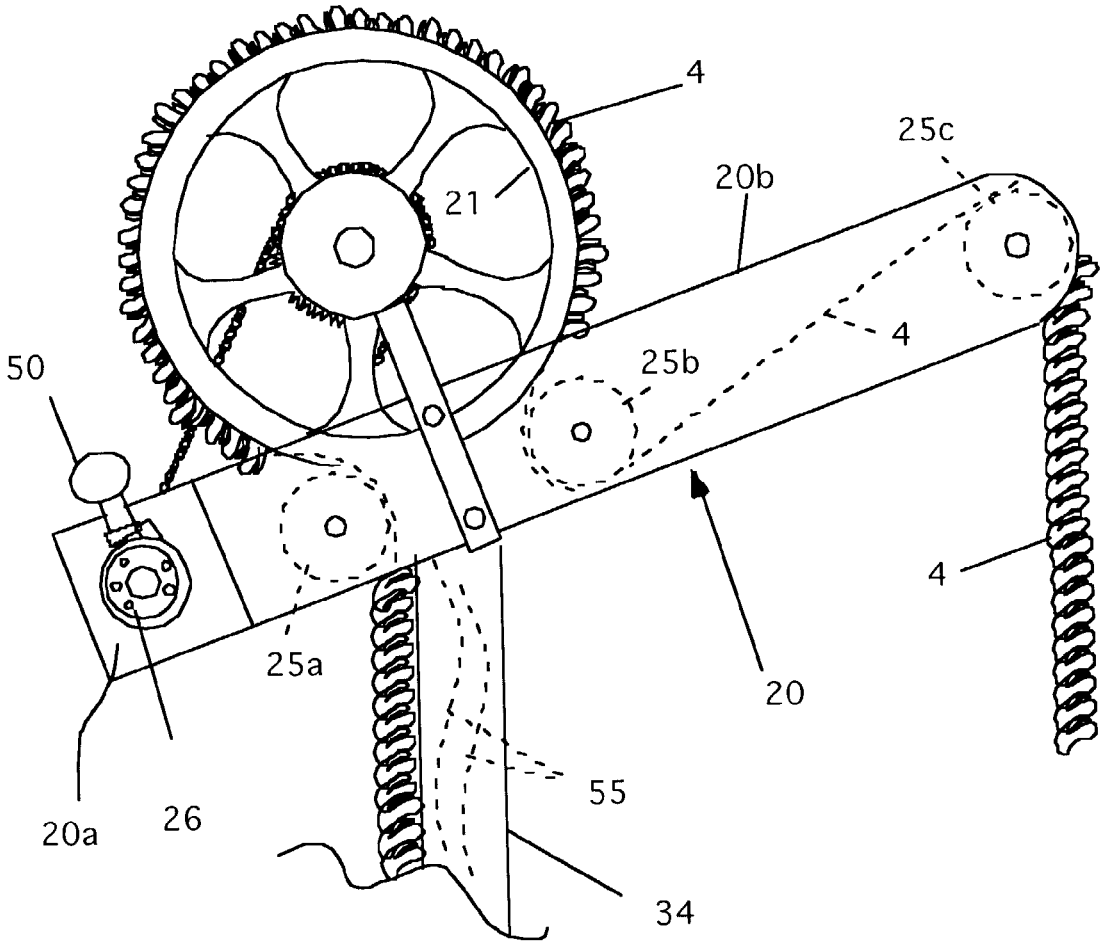
FIG. 3 is a detail view of the pulley and braking system from the left side of the machine.

FIG. 3 is a detail view of the pulley and braking system from the left side of the machine. The components discussed above are shown in this view from the other side of the machine (FIG. 2).

Braking is achieved by two different subsystems. First, is the hydraulic pump 26 that is attached to the end of the arm 20. The second is a piston and shaft structure that is attached to the main pulley 21. As the pulley turns the pump 26, friction is applied to the rope as it is squeezed between the sheeve 25*a*, the pulley 21 and the sheeve 25*b*. This is accomplished by a cylinder 47 that has an internal piston. A shaft 48, attached to the piston, extends out of the cylinder and attaches to the main pulley 21. As the rope is pulled down, it causes the piston to slide inside the cylinder 47, which pulls the main pulley 21 down against the rope and the sheeves 25*a* and 25*b*. This system works better than a spring tensioning system because a spring system is always in tension, thus always putting pressure on the rope. This system places no tension on the rope when the rope is not being pulled. Therefore, the system engages only when a user pulls on the rope. Moreover, the system automatically applies pressure proportionately to the force pulling on the rope. Thus, a lighter person applies less tension to the rope than a heavier person does. Because the rubbing of the rope over the pulleys causes the rope to wear, the less force applied to the rope, the longer the rope lasts.

The pump force can be controlled to give the user the proper pulling resistance. The rope cannot be too free to move, or the user gets no benefit of "climbing" the rope. When the control valve 42 (see FIG. 5) is set properly, the user can pull on the rope to lift the user off the seat, as the rope feeds and the user continues to climb, the user can maintain that position as long as desired.

Figure 5:
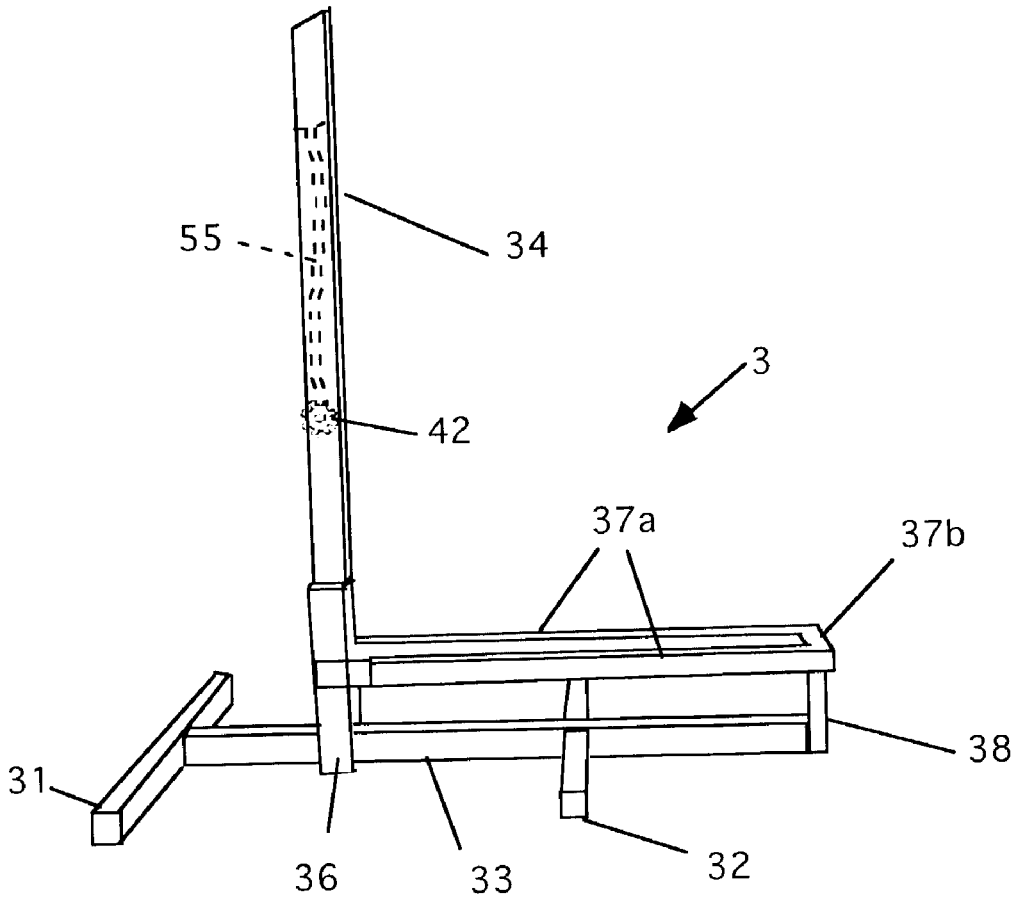
FIG. 5 is a left side view of the frame.

The hydraulic system is shown in FIGS. 3 and 5. The system uses a hydraulic pump to transfer a fixed quantity of fluid that is held in a reservoir 50. Hydraulic lines 55 are run down inside the vertical support 34 to a control valve 42 (see FIG. 5). The control valve permits a varying amount of fluid to flow through the pump 26. For example, if the valve is fully closed, no fluid flows and the pump cannot be turned. This means the main drive pulley 21 does not turn. Note that this is why the tensioning system discussed above is needed. Without it, the rope 4 can be pulled over the main pulley 21 even though the pulley does not turn. As the valve is opened, fluid is allowed to flow, which permits the main pulley to turn. As the valve is opened, the pulley becomes easier to turn.

Figure 4:
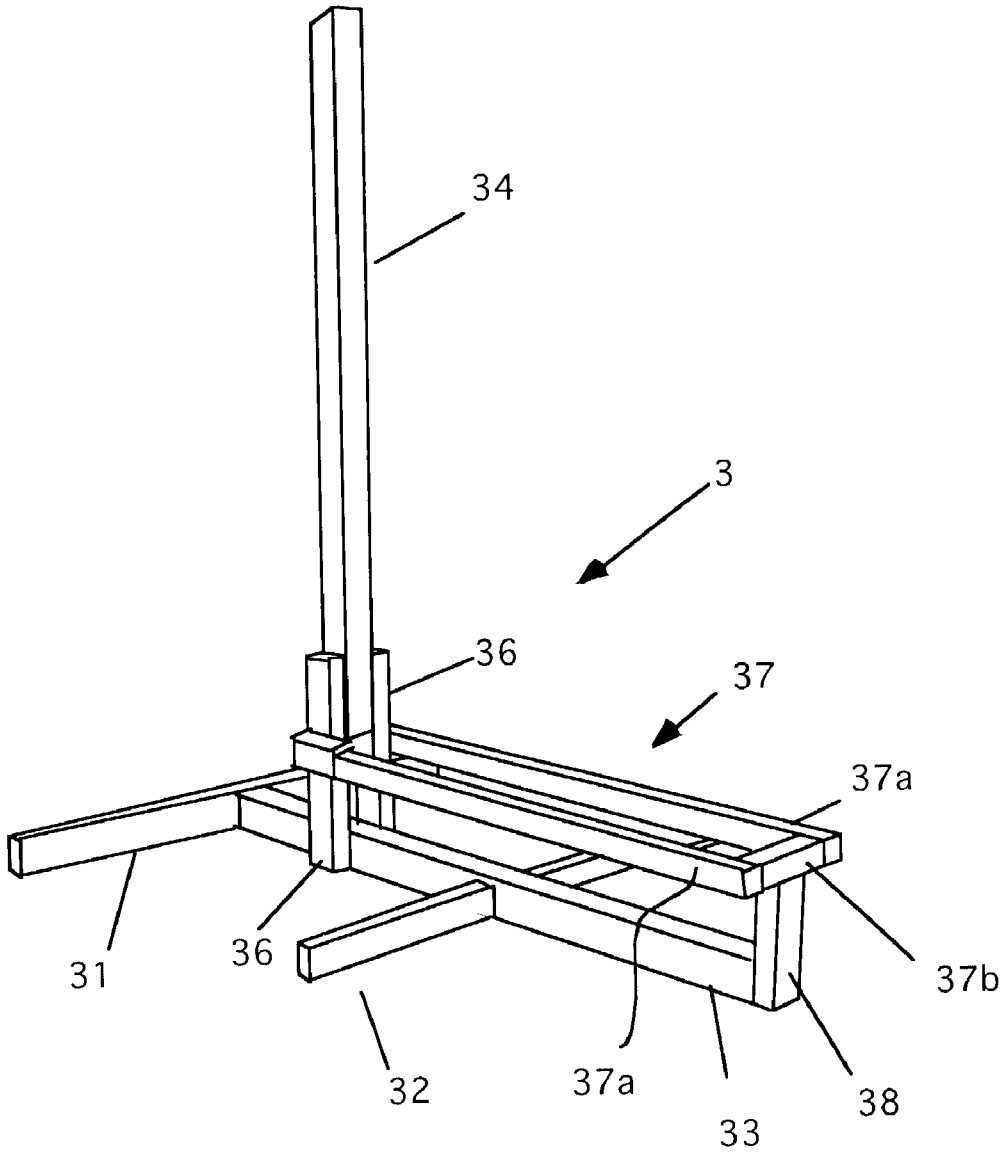
FIG. 4 is a perspective view of the frame without the seat.

FIGS. 4–7 show details of the frame construction. FIG. 4 is a perspective view of the frame without the seat. FIG. 5 is a left side view of the frame. In these two views, the frame 3 is shown. The frame 3 has a first horizontal base member 31 and a second horizontal base member 32 as shown. A lower seat frame member 33 extends back from the first horizontal member 31. The vertical support 34 is held above the top of the lower seat frame member 33 and is secured to the lower seat frame member 33 by side braces 36. The upper seat frame 37 consists of two side members 37*a* and a back member 37*b*. The front ends of the two side members 37*a* attach to the side braces 36 as shown. A rear support 38 connects the lower seat frame member 33 to the back member 37*b* as shown.

Note that FIG. 4 shows a channel formed between the two upper seat members 37*a*. This channel allows the rope to pass through the seat frame. Note also, that as discussed above, the vertical support is held above the lower seat frame member 33. This is done to create a space through which the rope 4 passes to reach the back of the machine. In this way, the rope is led safely through the frame, where it cannot interfere with the user or anyone passing by the machine. See FIG. 7.

Figure 6:
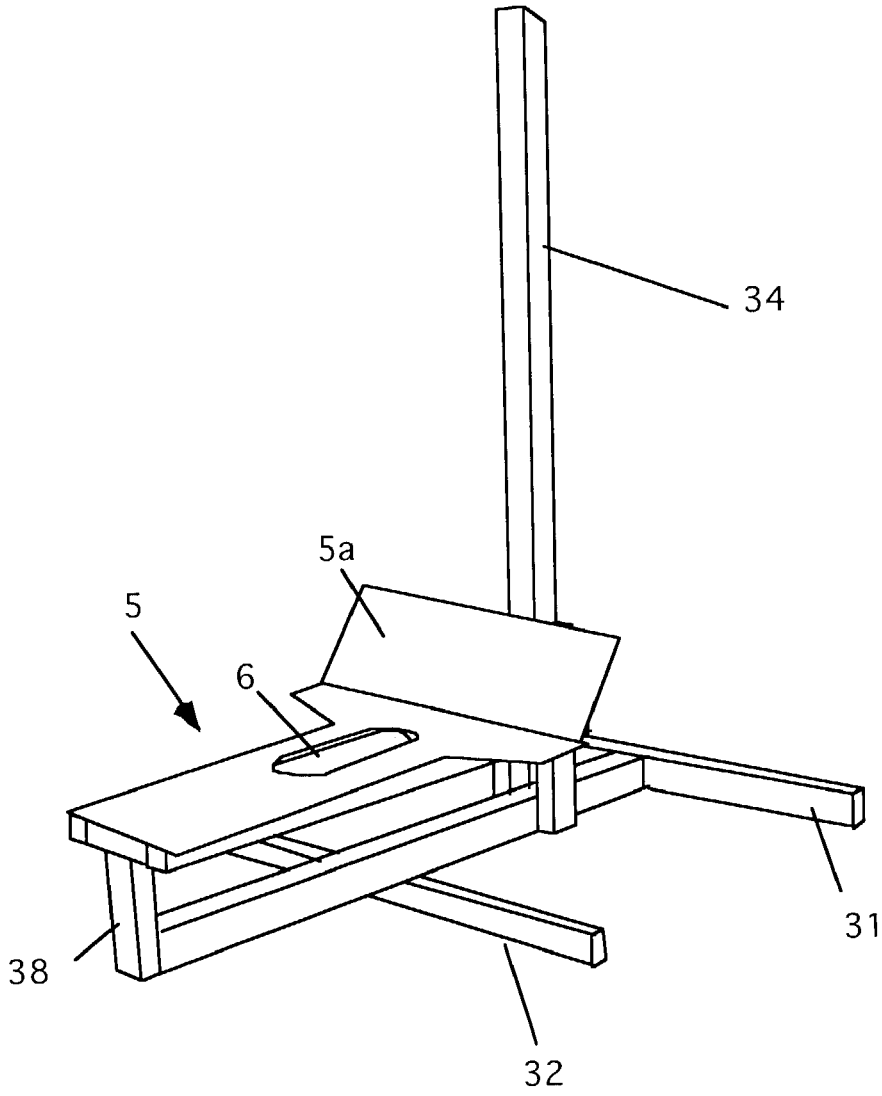
FIG. 6 is a perspective view of the frame and seat

FIG. 6 is a perspective view of the frame and seat. The seat 5 is attached to the upper seat frame 37 using fasteners common to the art. As mentioned above, the seat 5 has a center oblong hole 6 formed in it to receive the rope 4 as it passes into the frame. The hole 6 is oblong to provide room for the rope as a user is exercising. The front 5*a* of the seat is angled upward, forming a footrest. This allows a user to place the user's feet on the footrest while exercising. In this way, the user can lift up off the seat bottom during a work out, providing a closer simulation to being suspended from a rope. Note that in the preferred embodiment, the seat 5 is padded and the footrest 5*a* is made of metal.

The use of the device is simple. A user first sets the control valve 42 to the proper setting, based on the user's weight. Then, the user sits on the bench with the rope hanging vertically between the user's legs. The user can then pull the rope downward. To do this the user must overcome the resistance of the brake. The ideal setting is where the user pulls him or her up slightly off the seat, and remains suspended while climbing the rope.

To gain even more advantage, the user can place the user's feet on the footrest to use the user's legs to maintain the elevated position. The user then pulls the rope down as though it is being climbed. The user can continue in this manner for as long as desired.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

We claim:

1. An endless rope exercise machine comprising:

a) a frame having a vertical portion and a horizontal portion, said vertical portion having a top and a bottom, said horizontal portion having a front and a back, said bottom of said vertical portion having an opening therein, said horizontal portion also having an opening formed therein, said frame being assembled such that the bottom of said vertical portion is aligned with the front of said horizontal portion, said horizontal portion also having a height and further wherein said height of said horizontal portion is sufficient to allow a user to sit on said horizontal portion with the user's legs at an angle of approximately 90 degrees when said user's feet are positioned on a floor;

b) a braking mechanism, having an inlet end and an outlet end, attached to said vertical portion of said frame;

c) a means for attaching said braking mechanism to said frame;

d) an endless rope, said endless rope being positioned about said frame as follows; said endless rope being in operative engagement with said braking mechanism, extending out from said outlet end of said braking mechanism and extending outward from said braking mechanism, passing through said opening in said horizontal portion of said frame, passing through said opening in said vertical portion, and extending to said inlet of said braking mechanism; and e) a footrest attached to said horizontal portion and extending upwardly therefrom.

2. The exercise device of claim 1 wherein the braking mechanism includes:

i) a drive pulley;

ii) a sprocket attached to said drive pulley;

iii) at least one tension pulley, attached to said braking mechanism such that said endless rope is placed between said drive pulley and said tension pulley; and iv) a means for restraining the movement of said drive pulley, operatively engaged with said drive pulley.

3. The exercise device of claim 2 wherein the means for restraining the movement of said drive pulley, operatively engaged with said drive pulley comprise:

a) a hydraulic pump, said hydraulic pump having a shaft;

b) a second sprocket, attached to said shaft;

c) a chain, attached to said second sprocket and to said sprocket on said drive pulley, such that said hydraulic pump exerts a force on said drive pulley; and d) a means for controlling the force applied to said drive pulley by said hydraulic pump.

4. The exercise device of claim 3 wherein the means for restraining the movement of said drive pulley further comprise:

a) a shaft, attached to said drive pulley, said shaft having a piston attached thereto; and b) a cylinder, attached to said means for attaching said braking mechanism to said frame, whereby when said rope is pulled downward, said drive pulley forces said shaft to slidably engage said piston in said cylinder such that said rope is compressed between said drive pulley and said at least one tension pulley.

5. The exercise device of claim 3 wherein the means for controlling the force applied to said drive pulley by said hydraulic pump comprises a valve, in hydraulic communication with said pump.

6. The exercise device of claim 3 further comprising a reservoir in hydraulic communication with said pump.

7. The exercise device of claim 1 further comprising a seat, attached to horizontal portion.

* * * * *